US006752557B1

(12) United States Patent
Hsieh

(10) Patent No.: US 6,752,557 B1
(45) Date of Patent: Jun. 22, 2004

(54) RETRACTILE PEN

(76) Inventor: Ming-Jen Hsieh, No. 21, Sec. 3, Mu Hsin Rd., Wen Shan District, Taipei (TW)

( * ) Notice: Subject to any disclaimer, the term of this patent is extended or adjusted under 35 U.S.C. 154(b) by 0 days.

(21) Appl. No.: 10/690,588

(22) Filed: Oct. 23, 2003

(51) Int. Cl.[7] ..... B43K 7/12
(52) U.S. Cl. ..... 401/117; 401/104; 401/105
(58) Field of Search ..... 401/117, 104, 401/105, 109, 112, 131

(56) References Cited

U.S. PATENT DOCUMENTS 2,722,914 A * 11/1955 Aversa ..... 401/105
3,657,812 A * 4/1972 Lee ..... 30/162
4,601,599 A * 7/1986 Katoh ..... 401/99
6,309,122 B1 * 10/2001 Wang ..... 401/112

* cited by examiner

*Primary Examiner*—David J. Walczak
(74) *Attorney, Agent, or Firm*—Dennison, Schultz, Dougherty & MacDonald

(57) ABSTRACT

A retractile pen includes axially slidably connected front and rear casings, an internal sleeve slidably mounted in the rear casing to hold an ink cartridge having a front portion extended into the front casing, and an adjusting button located above a guide slot provided on the rear casing to connect with the internal sleeve via a stem portion extended from the adjusting button through the guide slot. When the adjusting button is depressed and moved to a rear or a front end of the guide slot, the internal sleeve is held in place to retract or extend the ink cartridge, respectively, and the rear casing may be pushed toward or away from the front casing to shorten or increase an overall length of the pen.

5 Claims, 3 Drawing Sheets

RETRACTILE PEN

FIELD OF THE INVENTION

The present invention relates to a retractile pen, and more particularly to a pen including slidably connected front and rear casings, so that the pen may be shortened for storage, or extended for comfortable holding during writing.

BACKGROUND OF THE INVENTION

There are a variety of retracting structures designed for pens. For example, U.S. Pat. No. 6,276,855 B1 discloses a retractile pen, a casing of which may be shortened to enable positioning of the pen in a small pocket, or extended to enable easy holding and comfortable writing.

It is desirable to develop a new retractile pen that may be easily operated to a retracted state for storage or an extended state for writing.

SUMMARY OF THE INVENTION

A primary object of the present invention is to provide a retractile pen that includes axially slidably connected front and rear casings, an internal sleeve slidably mounted in the rear casing to hold an ink cartridge, a front portion of which is extended into the front casing, and an adjusting button located above a guide slot provided on the rear casing to connect to the internal sleeve via a stem portion of the button extended through the guide slot. When the adjusting button is depressed, it may be moved along the guide slot to bring the internal sleeve to a rear or a front locating hole formed at rear and front end of the guide slot, respectively, so as to hold the ink cartridge in a retracted or extended position. Meanwhile, when the adjusting button is depressed, the rear casing may be pushed toward or away from the front casing to shorten or increase an overall length of the pen, respectively.

The retractile pen of the present invention further includes a clip connected to the rear casing. The clip is provided with an axially extended slide slot corresponding to the guide slot on the rear casing. The adjusting button is located at an outer side of the clip with the stem portion extended through the slide slot and the guide slot to connect with the internal sleeve. When the adjusting button is moved to the front end of the slide slot to hold the internal sleeve in place and the ink cartridge in the extended position, the stem portion stops the clip from opening to clamp the pen to a pocket, protecting the pocket from being smudged by an exposed writing tip of the ink cartridge.

The adjusting button may have a selected size and shape to enable convenient operation by a user, and specific patterns may be printed on a top of the adjusting button as an advertisement.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
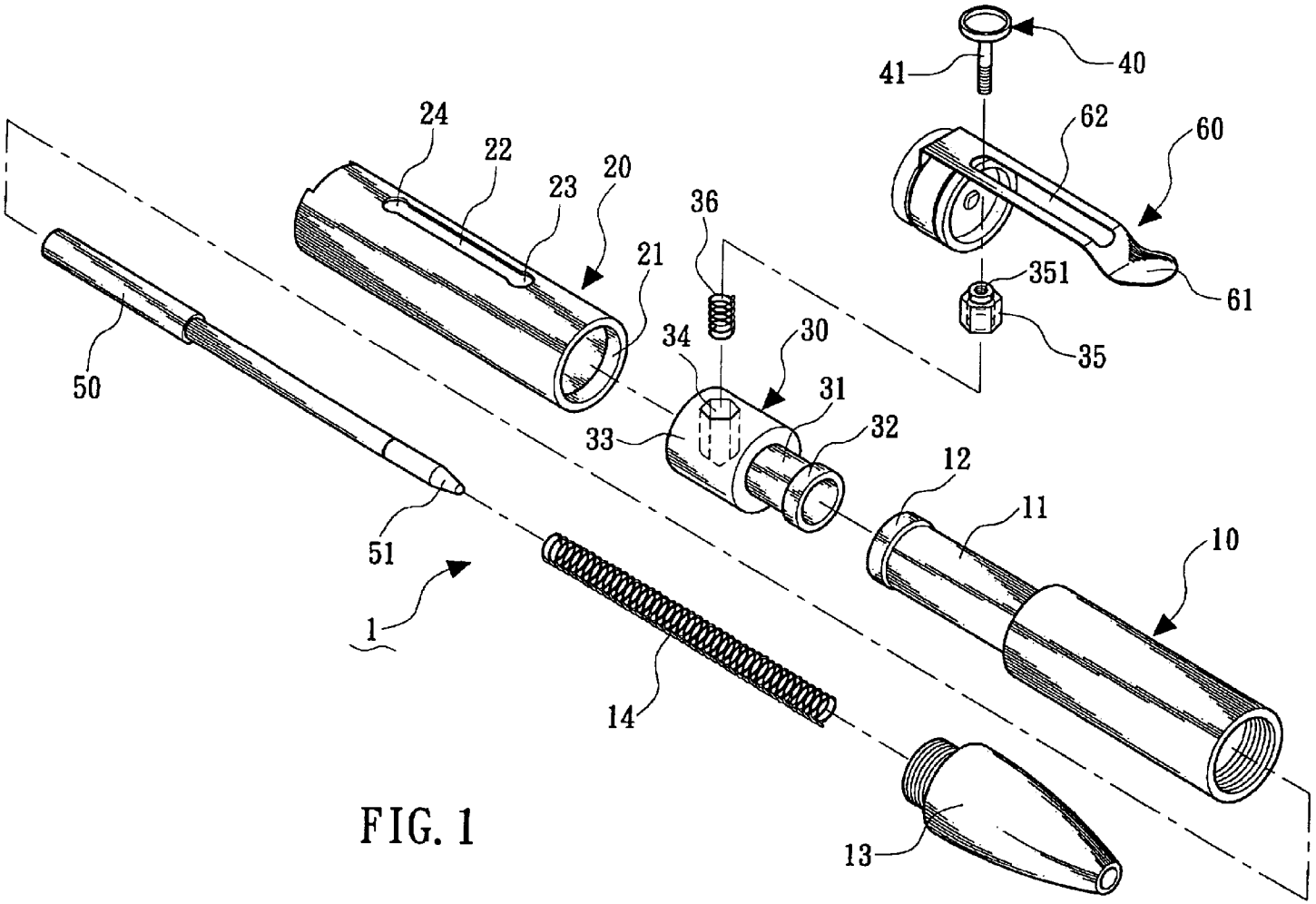
FIG. 1 is an exploded perspective view of a retractile pen according to the present invention.
Figures 2A, 2B, 2C:
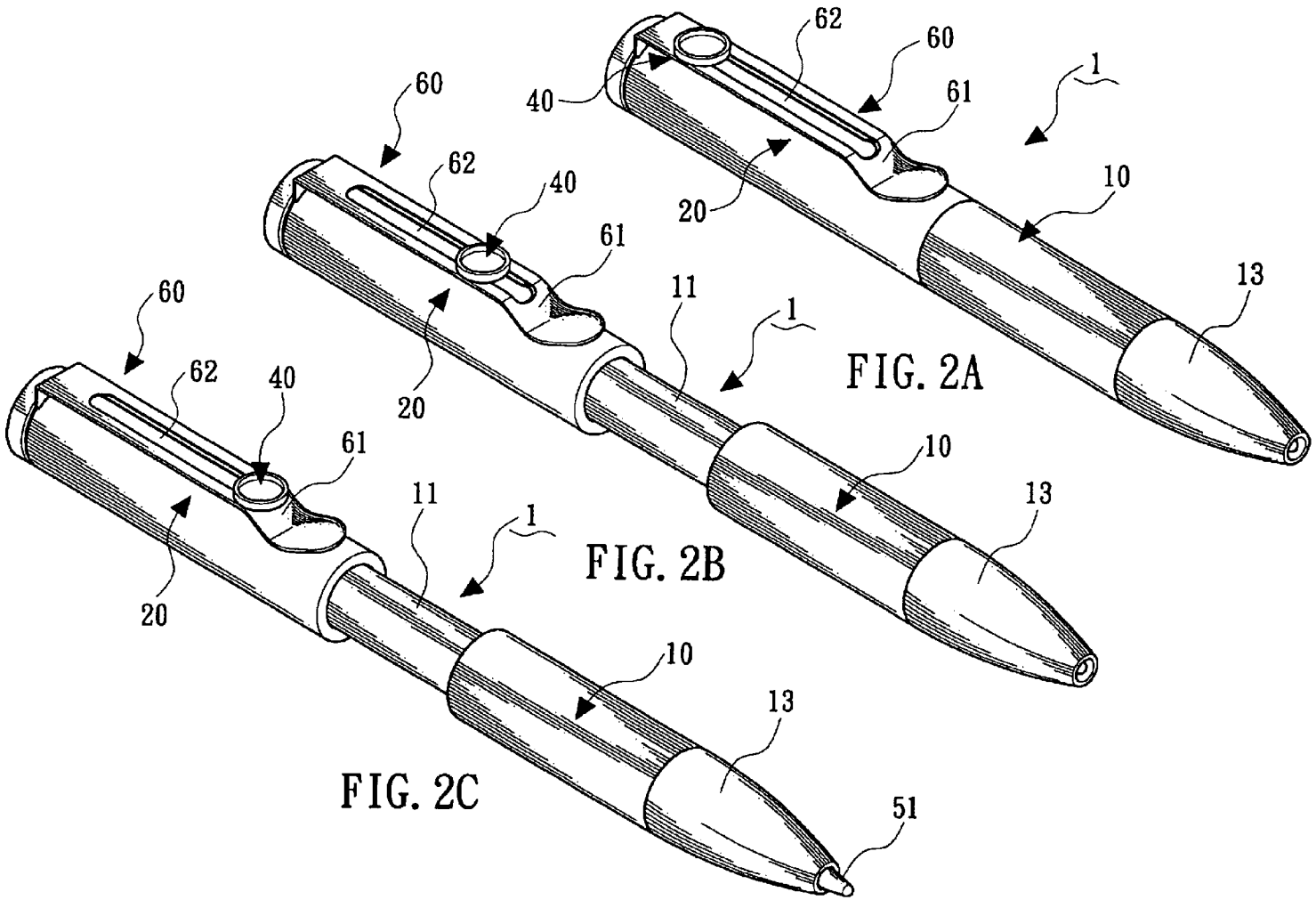
FIG. 2A is an assembled perspective view of the retractile pen of FIG. 1 in a fully retracted state for storage.
FIG. 2B is an assembled perspective view of the retractile pen of FIG. 1 in a half-extended state.
FIG. 2C is an assembled perspective view of the retractile pen of FIG. 1 in a fully extended state for writing.
Figure 3A:
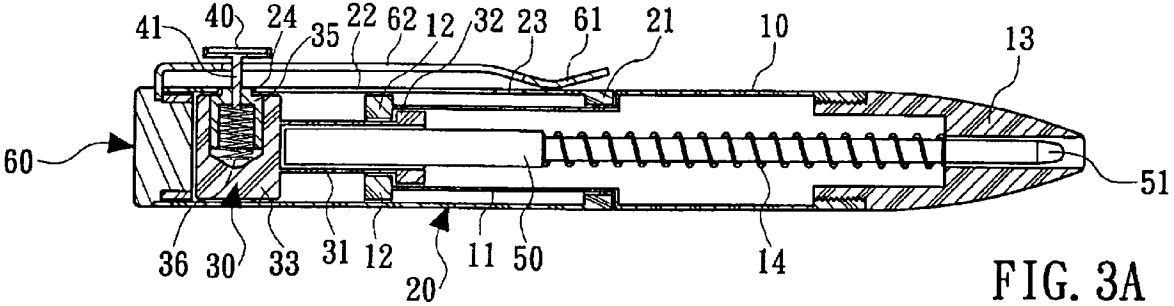
FIG. 3A is a sectioned side view of FIG. 2A.

Please refer to FIGS. 1, 2A, and 3A, in which a retractile pen 1 according to the present invention is shown. As shown, the retractile pen 1 mainly includes a front casing 10, a rear casing 20, an internal sleeve 30, and an adjusting button 40.

The front casing 10 includes a diameter-reduced rear section 11, around a rear end of which a first stop flange 12 is provided to radially inward and outward project from the rear end.

Figure 3B:
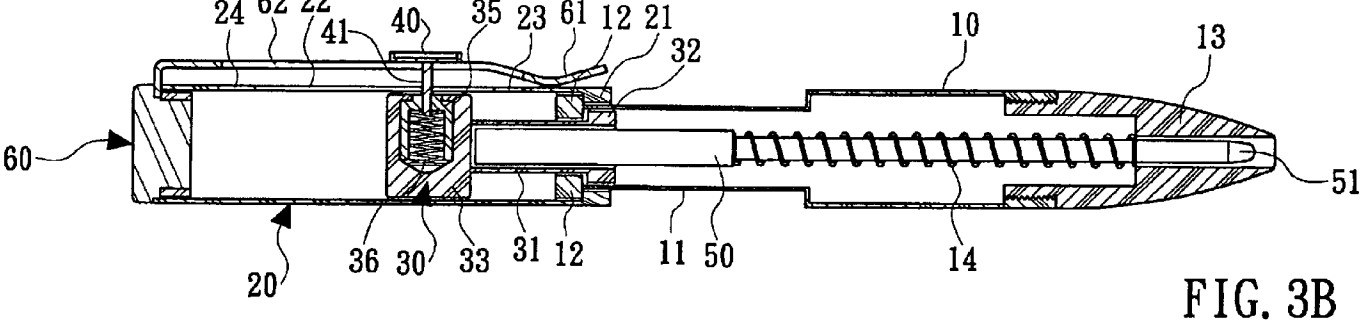
FIG. 3B is a sectioned side view of FIG. 2B.
Figure 3C:
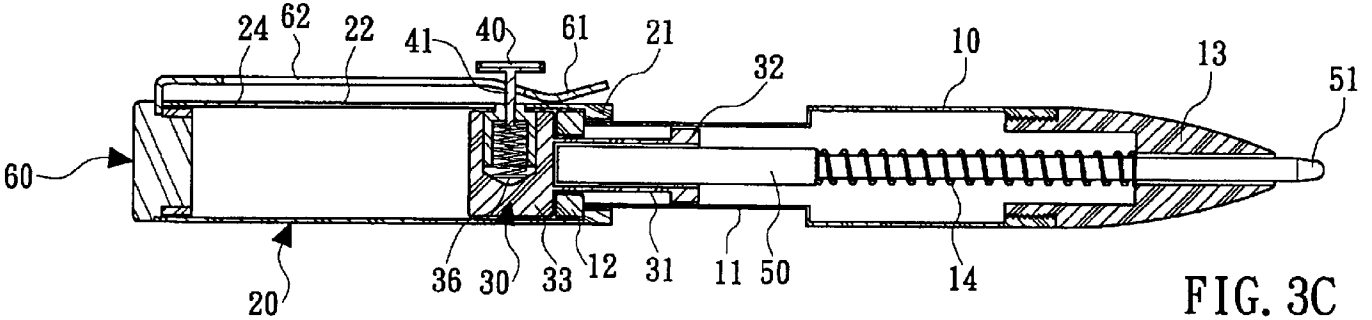
FIG. 3C is a sectioned side view of FIG. 2C.

The rear casing 20 is provided at a front end with a second stop flange 21 that radially inward projects from the front end. The rear casing 20 is axially slidably mounted around the diameter-reduced rear section 11 of the front casing 10, such that the second stop flange 21 abuts against the first stop flange 12 when the front casing 10 is fully moved forward relative to the rear casing 20, preventing the front casing 10 from completely separating from the rear casing 20, as shown in FIGS. 3B and 3C. An axially extended guide slot 22 is provided on the rear casing 20. Front and rear ends of the guide slot 22 are formed into two locating holes 23, 24 having a diameter slightly larger than a width of the guide slot 22.

The internal sleeve 30 is axially slidably mounted in the rear casing 20 behind the diameter-reduced rear section 11 of the front casing 10. The internal sleeve 30 includes a diameter-reduced front section 31 adapted to forward extend into the rear section 11 of the front casing 10, and a diameter-expanded rear section 33. A third stop flange 32 is provided around a front end of the front section 31 to radially outward project therefrom. The third stop flange 32 is adapted to abut against the first stop flange 12 when the internal sleeve 30 is rearward moved relative to the front casing 10, and thereby prevents the internal sleeve 30 from completely separating from the front casing 10, as shown in FIGS. 3A and 3B. A hollow front cap 13 is connected to an open front end of the front casing 10, so that an ink cartridge 50 having a rear portion inserted in the diameter-reduced front section 31 of the internal sleeve 30 and a front portion extended into the front casing 10 may be forward moved to expose a writing tip 51 from the front cap 13. A spring 14 is mounted on the ink cartridge 50 behind the front cap 13. The rear section 33 of the internal sleeve 30 is fitly received in the rear casing 20 to smoothly slide axially. A shoulder portion is formed between the expanded rear section 33 and the reduced front section 31, and is adapted to abut against the first stop flange 11 when the internal sleeve 30 is fully moved forward relative to the rear casing 20, as shown in FIG. 3C.

The rear section 33 of the internal sleeve 30 is provided at one side with a radially extended hole 34, in which a hollow retaining block 35 having a restoring spring 36 mounted therein is received. The retaining block 35 includes a diameter-reduced top 351 having a configuration corresponding to that of the front and rear locating holes 23, 24 of the guide slot 22 on the rear casing 20. When the internal sleeve 30 is axially moved in the rear casing 20, the retaining block 35 and the reduced top 351 are normally located below the guide slot 22, and when the reduced top 351 reaches at the front or the rear end of the guide slot 22, the reduced top 351 is allowed to project from the expanded front or rear locating hole 23, 24 and thereby stops the internal sleeve 30 from moving forward or rearward any further.

The adjusting button 40 includes a stem portion 41 that is extended through the guide slot 22 on the rear casing 20 into the diameter-reduced top 351 of the retaining block 35, and thereby brings the internal sleeve 30 to move along with the adjusting button 40.

A rear cap 60 is connected to a rear end of the rear casing 20 with a clip 61 forward extended from one side of the rear cap 60 to fitly press against an outer surface of the rear casing 20 and fixedly located immediately above the guide slot 22. The clip 61 is provided with an axially extended slide slot 62 corresponding to the guide slot 22. The adjusting button 40 is located on an outer side of the clip 61 with the stem portion 41 extended through the slide slot 62 into the guide slot 22 and the reduced top 351 of the retaining block 35.

Please refer to FIGS. 2A and 3A. When the pen 1 is not in use and to be stored, the adjusting button 40 connected to the retaining block 35 is depressed and fully moved rearward along the slide slot 62, allowing the reduced top 351 of the retaining block 35 to upward project into the expanded rear locating hole 24 and thereby holds the internal sleeve 30 to a rearmost position in the rear casing 20. At this point, the ink cartridge 50 is in a retracted position and the writing tip 51 is completely located in the front cap 13, and the rear casing 20 may be pushed toward the front casing 10 until the second stop flange 21 at the front end of the rear casing 20 is abutted on the front casing 10. The pen 1 will have a shortest possible length in this state and may be conveniently put in a pocket.

Please refer to FIGS. 2B and 3B. When it is desired to use the pen 1 to write, first depress the adjusting button 40 to disengage the reduced top 351 of the retaining block 35 from the rear locating hole 24 on the rear casing 20, and then pull the rear casing 20 rearward to expose the rear section 11 of the front casing 10, so as to extend the length of the pen 1. Meanwhile, the depressed adjusting button 40 is gradually moved along the guide slot 22 toward the front locating hole 23, and the ink cartridge 50 is still in a retracted position without exposing the writing tip 51 from the front cap 13.

Please refer to FIGS. 2C and 3C. When the depressed adjusting button 40 is further moved to locate the retaining block 35 below the front locating hole 23 and released, the internal sleeve 30 is moved to a most front end of the rear casing 20 with the reduced top 351 of the retaining block 35 upward engaged with the front locating hole 23, allowing the writing tip 51 of the ink cartridge 50 to expose from the front cap 13 and be held to this extended position. The pen 1 in the extended state has an increased length to enable comfortable holding of the pen 1 for writing. An elastic force from the spring 14 makes the ink cartridge 50 firmly located between the internal sleeve 30 and the front cap 13. When the pen 1 is operated to return to the retracted state, a rearward restoring force from the spring 14 enables the internal sleeve 30 to move rearward more easily.

As can be clearly seen from FIGS. 2C and 3C, when the adjusting button 40 is held to the most front end of the slide slot 62 on the clip 61 through engagement of the reduced top 351 of the retaining block 35 with the front locating hole 23 on the guide slot 22, the stem portion 41 of the adjusting button 40 forms a stopper at a front end of the clip 61. When a user intends to clamp the pen 1 in the extended state to a pocket using the clip 61, the stem portion 41 of the adjusting button 40 at the front end of the slide slot 62 stops the clip 60 from opening for use. Therefore, the risk of a smudged pocket due to the exposed writing tip 51 may be effectively eliminated.

The adjusting button 40 may be designed according to body engineering to facilitate easy and comfortable push or operation thereof. Moreover, patterns may be selectively printed on a top of the adjusting button 40 to provide an advertising effect.

What is claimed is:

1. A retractile pen, comprising a front casing, a rear casing, an internal sleeve, an ink cartridge, and an adjusting button;

said front casing including a diameter-reduced rear section adapted to be axially slidably fitted in said rear casing, said rear section being provided around a rear end with a first stop flange radially inward and outward projected from the rear end of said rear section, and a front cap being connected to an open front end of said front casing;

said rear casing being axially slidably mounted around an outer surface of said reduced rear section of said front casing, said rear casing being provided around a front end with a second stop flange that is radially inward projected from the front end and adapted to abut against said first stop flange of said front casing, preventing said rear casing from completely separating from said front casing when said rear casing is moved rearward relative to said front casing; said rear casing being provided at one side with an axially extended guide slot, front and rear ends of which being expanded to provide a front and a rear locating hole, respectively;

said internal sleeve being axially slidably mounted in said rear casing behind said diameter-reduced rear section of said front casing; said internal sleeve including a diameter-reduced front section adapted to forward extend into said rear section of said front casing, and a diameter-expanded rear section; a third stop flange being provided around a front end of said reduced front section to radially outward project therefrom; said third stop flange being adapted to abut against said first stop flange when said internal sleeve is rearward moved relative to said front casing, and thereby preventing said internal sleeve from completely separating from said front casing; said expanded rear section of said internal sleeve being fitly received in said rear casing to smoothly slide axially, and provided at one side with a radially extended hole, in which a hollow retaining block is elastically movably received;

said adjusting button including a stem portion that is extended through said guide slot on said rear casing into said retaining block and thereby brings said internal sleeve in said rear casing to move along with said adjusting button;

said ink cartridge including a rear portion received in said diameter-reduced front section of said internal sleeve, and a front portion forward extended into said front casing and said front cap, and a spring being mounted on said ink cartridge behind said front cap;

whereby when said adjusting button is depressed and moved rearward to locate said retaining block in said rear locating hole of said guide slot on said rear casing, said ink cartridge is retracted into said front cap, and said rear casing may be pushed toward said front casing to shorten an overall length of said pen; and when said adjusting button is depressed and moved forward to bring said retaining block out of said rear locating hole, said rear casing may be pushed away from said front casing to increase an overall length of said pen; and when said adjusting button is fully moved forward to locate said retaining block in said front locating hole of said guide slot, said writing tip of said ink cartridge is exposed from said front cap and held thereat for writing.

2. The retractile pen as claimed in claim 1, wherein said retaining block includes a diameter-reduced top having a configuration corresponding to that of said front and rear locating holes of said guide slot on said rear casing; whereby when said internal sleeve is axially moved in said rear casing, said retaining block and said reduced top are normally located below said guide slot, and when said internal sleeve reaches at front or rear end of said rear casing, said reduced top of said retaining block is upward projected into said front or rear locating hole of said guide slot to stop said internal sleeve from moving forward or rearward any further.

3. The retractile pen as claimed in claim 1, further comprising a rear cap mounted to a rear end of said rear casing; said rear cap is provided at one side with an axially forward extended clip for normally pressing against an outer surface of said rear casing.

4. The retractile pen as claimed in claim 3, wherein said clip is located immediately above said guide slot on said rear casing, and includes an axially extended slide slot corresponding to said guide slot; and said adjusting button being located at an outer side of said clip to downward extend through said slide slot on said clip and said guide slot on said rear casing, in order to connect with said retaining block.

5. The retractile pen as claimed in claim 3, wherein said adjusting button includes a stem portion that extends through said slide slot and said guide slot to connect to said retaining block, and stops a front end of said clip from being opened when said adjusting button is fully moved forward to locate said retaining block in said front locating hole.

* * * * *